US008841533B2

(12) United States Patent
Bissoli

(10) Patent No.: US 8,841,533 B2
(45) Date of Patent: Sep. 23, 2014

(54) TOOL FOR PERFORMING WORK TO CORRECT ARC OF FRET, FRET BOARD OR FINGER BOARD AND ADJUSTMENT AT ONCE WITH STRINGS OF STRINGED INSTRUMENT ATTACHED

(76) Inventor: Davide Bissoli, Suginami (JP)

( * ) Notice: Subject to any disclaimer, the term of this patent is extended or adjusted under 35 U.S.C. 154(b) by 0 days.

(21) Appl. No.: 13/814,499

(22) PCT Filed: Aug. 8, 2011

(86) PCT No.: PCT/JP2011/068052

§ 371 (c)(1),
(2), (4) Date: Feb. 5, 2013

(87) PCT Pub. No.: WO2012/018138

PCT Pub. Date: Feb. 9, 2012

(65) Prior Publication Data

US 2013/0125731 A1 May 23, 2013

(30) Foreign Application Priority Data

Aug. 6, 2010 (JP) ..... 2010-005282 U

(51) Int. Cl.

| | |
|---|---|
| ***G10D 9/00*** | (2006.01) |
| ***B24D 15/02*** | (2006.01) |
| ***G10G 7/00*** | (2006.01) |
| ***G10D 1/00*** | (2006.01) |
| *G10D 3/06* | (2006.01) |
| *G10D 3/00* | (2006.01) |

(52) U.S. Cl.

CPC .. *G10G 7/00* (2013.01); *G10D 3/06* (2013.01); *B24D 15/02* (2013.01); *G10D 1/005* (2013.01); *G10D 3/00* (2013.01)

USPC ..... 84/453

(58) Field of Classification Search

USPC ..... 84/454–459, 312 R, 453

See application file for complete search history.

(56) References Cited

U.S. PATENT DOCUMENTS

| | | | | |
|---|---|---|---|---|
| 4,037,510 | A * | 7/1977 | Ginex et al. | 84/453 |
| 6,563,037 | B2 * | 5/2003 | Hamilton | 84/484 |
| 2008/0271587 | A1 | 11/2008 | Cross | |

FOREIGN PATENT DOCUMENTS

JP 52112312 A 9/1977

OTHER PUBLICATIONS

International Search Report mailed Oct. 25, 2011, issued in corresponding International Application PCT/JP2011/068052, filed Aug. 8, 2011, 2 pages.

* cited by examiner

*Primary Examiner* — Kimberly Lockett

(74) *Attorney, Agent, or Firm* — Christensen O'Connor Johnson Kindness PLLC

(57) ABSTRACT

Provided is a tool for simultaneously correcting a radius of curvature of frets, a fretboard or a fingerboard of a stringed instrument and leveling the frets while strings are on the stringed instrument. In order to introduce the strings of the stringed instrument inside the tool, the tool includes grooves, provided at the bottom of the tool, and spaces leading from the grooves, provided inside the tool. The tool is moved back and forth, in a condition where the bottom of the tool contacts the polishing object, while the strings are on the stringed instrument.

5 Claims, 2 Drawing Sheets

TOOL FOR PERFORMING WORK TO CORRECT ARC OF FRET, FRET BOARD OR FINGER BOARD AND ADJUSTMENT AT ONCE WITH STRINGS OF STRINGED INSTRUMENT ATTACHED

TECHNICAL FIELD

The present invention relates to a tool used for simultaneously correcting the radius of curvature of frets, a fretboard or a fingerboard of a stringed instrument and leveling the frets, while strings are on the stringed instrument.

BACKGROUND ART

Usually, for most cases where correction of radius of curvature of frets, a fretboard or a fingerboard of a stringed instrument or leveling the frets are conducted, such operation is conducted after the strings of the stringed instrument are loosened or removed.

However, adjustment conducted with the strings loosened or removed cannot be perfect, since the adjustment made is disturbed when the strings are restrung.

The present invention has been made to solve the aforementioned problem. An object of the present invention is to enable adjustment with the strings on, such condition being the most suitable condition for adjusting the frets, the fretboard or the fingerboard, easily, quickly and with high accuracy.

SUMMARY OF THE INVENTION

Problems to be Solved by the Invention

Buzzing sounds and problem in producing sounds occur, since the frets, the fretboard or the fingerboard are often irregular, due to wearing during performance, assembly failure, natural settling of the wood of the fretboard and the like.

Conventional means were to conduct adjustment which involves loosening or removing the strings, thus resulting in longer working hours. In addition, accuracy is low since the adjustment made is disturbed when the strings are restrung.

The present invention has been made to solve the aforementioned problem. An object of the present invention is to enable simultaneously correcting the radius of curvature of the frets, the fretboard or the fingerboard of the stringed instrument and leveling the frets, while the strings are on, such condition being the most suitable condition for adjusting the frets, the fretboard or the fingerboard.

Means for Solving the Problems

The most major characteristics of the present invention is the feature which allows the tool to be inserted between the strings from the front face of a guitar, and allows polishing to be conducted merely by moving the tool back and forth in the longitudinal direction, thus enabling simultaneously correcting the radius of curvature of the frets, the fretboard or the fingerboard and leveling the frets, while the strings are on.

Effect of the Invention

By using the tool according to the present invention, correction of the radius of curvature in the width direction can be conducted for the frets, the fretboard or the fingerboard, while the strings are on the stringed instrument.

By using the tool according to the present invention, the frets, the fretboard or the fingerboard can be straightened in the longitudinal direction (leveled), while the strings are on the stringed instrument.

This adjustment resolves buzzing sounds and problem in producing sounds, and further lowers strings, which allows easier performance.

The tool according to the present invention is highly reduced in size, and is also a tool which, for the first time, enables simultaneously correcting the radius of curvature of frets, a fretboard or a fingerboard of a stringed instrument and leveling the frets, while strings are on the stringed instrument.

Since the tool according to the present invention is used while the strings are on the stringed instrument, working hours can be shortened, and adjustment accuracy is high.

EMBODIMENT FOR CARRYING OUT THE INVENTION

Hereinafter, the embodiments of the present invention will be explained referring to FIGS. 1 to 5.

Figure 1:
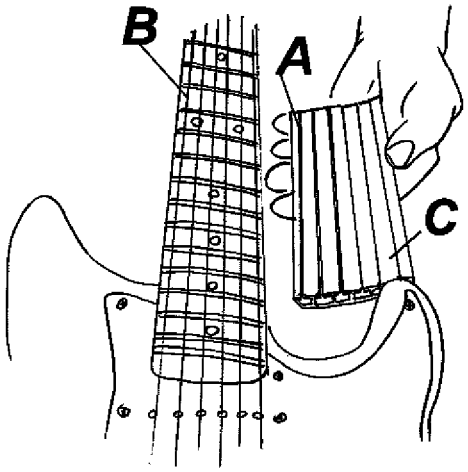
FIG. 1 is a front view of the tool according to the present invention.

FIG. 1 shows the tool according to the present invention and a guitar. The tool of the present invention has, on the bottom thereof, grooves (marked as "A") for allowing the strings (marked as "B") to be contained inside. The grooves enable the tool to be inserted between the strings, allowing the tool to reach the frets, the fretboard or the fingerboard. The tool has a portion (marked as "C") having a function equivalent to a file. The portion C is equipped with sandpaper, diamond powder and the like.

Figure 2:
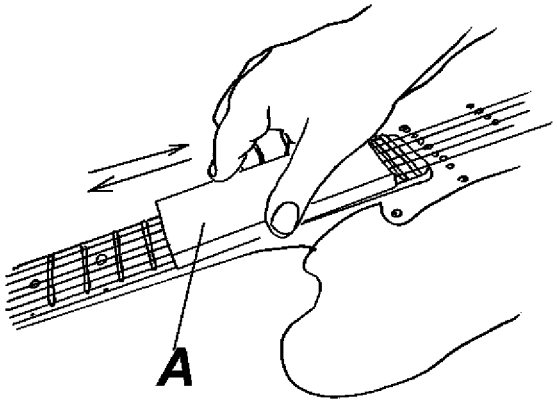
FIG. 2 is an upper perspective view of the tool according to the present invention.

FIG. 2 shows a guitar equipped with the tool according to the present invention. The effect of the present invention can be obtained by moving the tool (marked as "A") straightly back and forth, in the condition where the bottom of the tool fully comes in contact with a polishing object.

Figure 3:
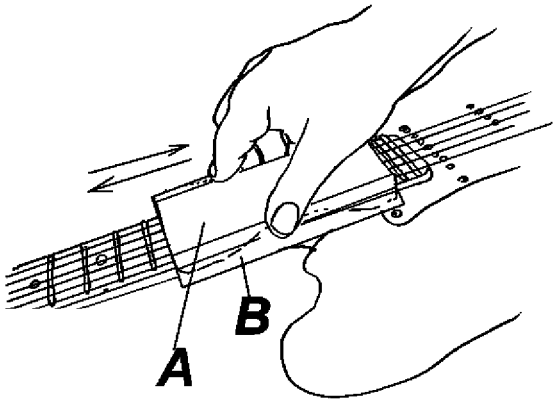
FIG. 3 is an upper perspective view of the tool according to the present invention.

FIG. 3 shows a guitar equipped with the tool (marked as "A") according to the present invention. The effect of the present invention can also be obtained by firmly holding a sandpaper (marked as "B") in between the strings and the frets, the fretboard or the fingerboard, and then moving the tool straightly back and forth.

Figure 4:
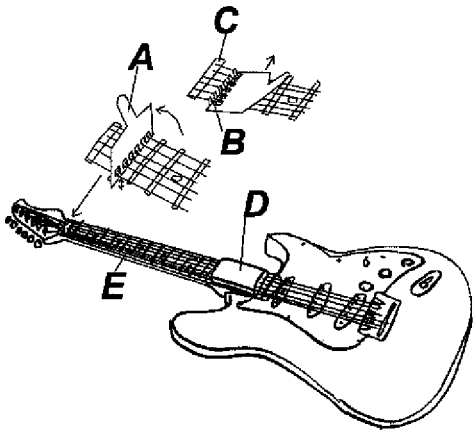
FIG. 4 is an explanatory drawing of an auxiliary tool.

FIG. 4 shows an auxiliary tool used during the operation. The auxiliary tool (marked as "A") assists the tool (marked as "D") so that the tool moves more smoothly, by lifting the strings to avoid the strings to come in contact with the tool.

The auxiliary tool of FIG. 4 is loaded as follows. First, the auxiliary tool is inserted from the front face of the guitar, between the strings, and then the auxiliary tool is slid so that the protruding portions (marked as "B") are placed under the strings. By turning up the handle (marked as "A"), the strings are lifted. The tool according to the present invention (marked as "D") is moved straightly back and forth over the fretboard (marked as "E") while the strings are lifted.

Figure 5:
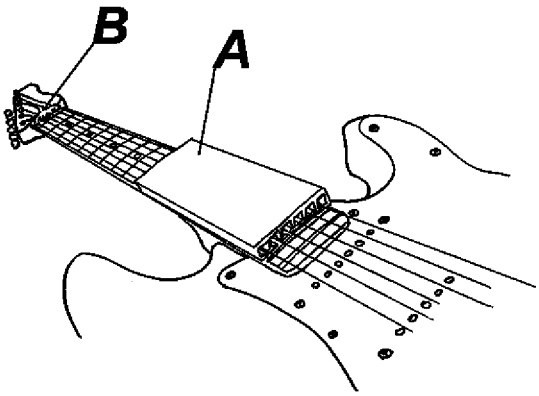
FIG. 5 is an explanatory drawing showing the tool and the auxiliary tool according to the present invention.

FIG. 5 shows the structure of the tool (marked as "A") according to the present invention. Continuous spaces are provided inside the tool. The strings can move freely through the spaces during the polishing.

FIG. 5 shows the auxiliary tool (marked as "B") loaded onto a guitar. Since the auxiliary tool (marked as "B") lifts the strings, the tool according to the present invention (marked as "A") can be moved without coming into contact with the strings.

The invention claimed is:

1. A tool for simultaneously correcting a radius of curvature of frets, a fretboard or a fingerboard of a stringed instrument and leveling the frets while strings are on the stringed instrument, comprising:

a soap-shaped rectangular body having a bottom, and grooves on the bottom, wherein the bottom is configured to be a polishing surface, be straight in a longitudinal direction thereof, be curved from an end to an other end in a crosswise direction thereof, and have grooves extending continuously in the longitudinal direction, and a number and a position of the grooves coincide with those of the stringed instrument, whereby the grooves are configured to allow the strings to be inserted in the soap-shaped rectangular body therethrough so that the polishing surface reaches the surfaces of the frets, a fretboard or a fingerboard.

2. The tool of claim 1, comprising:

spaces leading from the grooves, wherein the grooves and the spaces are provided by a number appropriate for a number of the strings of the stringed instrument, the grooves are configured to guide the strings the tool, and the spaces are shaped so that the strings stay inside the spaces while correcting the radius of curvature of frets, the fretboard or the fingerboard of the stringed instrument and leveling the frets, thereby preventing a movement of the tool from being disturbed.

3. The tool of claim 1, wherein the bottom of the tool is straight in the longitudinal direction thereof and is curved in the crosswise direction thereof, and the bottom of the tool is curved to match a shape of the frets, the fretboard or the fingerboard of the stringed instrument.

4. The tool of claim 1, wherein a width of the tool completely covers a maximum width of the frets, the fretboard or the fingerboard of the stringed instrument.

5. An auxiliary tool for assisting a tool of claim 1 to function appropriately when used with a stringed instrument, comprising:

a flat rectangular body, a plurality of rake-shaped teeth provided at an end of the flat rectangular body, the teeth having a tip portion folded to a direction perpendicular to the flat rectangular body, and a plurality of protruding portions provided at a corner of the tip portion of the plurality of teeth, wherein the protruding portions laterally protrude in the same direction, have a thickness configured to allow insertion of the protruding portions under the strings of the stringed instrument, and have a width having a different dimension from that of a thickness, configured to allow the protruding portions to lift the strings to a height necessary for preventing the strings from pushing a bottom of said tool while the tool is moved under the strings, and wherein a number of the teeth and a number of the protruding portions are identical to a number of the strings of the stringed instrument, and gaps between the protruding portions have a distance configured to allow a string with the largest diameter to pass through.

* * * * *